US012296436B2

(12) United States Patent
Venkatarayappa et al.

(10) Patent No.: US 12,296,436 B2
(45) Date of Patent: May 13, 2025

(54) ABRASIVE ARTICLES AND METHODS OF MAKING AND USING THE SAME

(71) Applicant: 3M INNOVATIVE PROPERTIES COMPANY, St. Paul, MN (US)

(72) Inventors: Raghunatha K. Venkatarayappa, Bangalore (IN); Jaime A. Martinez, Kissimmee, FL (US); Thomas J. Nelson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 782 days.

(21) Appl. No.: 17/423,816

(22) PCT Filed: Jan. 31, 2020

(86) PCT No.: PCT/IB2020/050810
§ 371 (c)(1),
(2) Date: Jul. 16, 2021

(87) PCT Pub. No.: WO2020/165683
PCT Pub. Date: Aug. 20, 2020

(65) Prior Publication Data

US 2022/0080554 A1 Mar. 17, 2022

Related U.S. Application Data

(60) Provisional application No. 62/803,879, filed on Feb. 11, 2019.

(51) Int. Cl.

| | |
|---|---|
| ***B24D 3/28*** | (2006.01) |
| ***B24D 11/00*** | (2006.01) |
| ***B24D 18/00*** | (2006.01) |

(52) U.S. Cl.
CPC ..... *B24D 3/28* (2013.01); *B24D 11/005* (2013.01); *B24D 18/0072* (2013.01)

(58) Field of Classification Search
CPC ..... B24D 18/0072; B24D 11/005; B24D 3/28
See application file for complete search history.

(56) References Cited

U.S. PATENT DOCUMENTS

| | | | |
|---|---|---|---|
| 1,910,444 | A | 5/1933 | Nicholson |
| 2,958,593 | A | 11/1960 | Hoover |

(Continued)

FOREIGN PATENT DOCUMENTS

| | | | |
|---|---|---|---|
| CN | 101693355 | B | 5/2012 |
| CN | 108326766 | A | 7/2018 |

(Continued)

OTHER PUBLICATIONS

"Alberdingk® U 6150", Technical Data Sheet, Alberdingk Boley, 2011, pp. 1-2.

(Continued)

*Primary Examiner* — Pegah Parvini
(74) *Attorney, Agent, or Firm* — Katherine M. Scholz

(57) ABSTRACT

An abrasive article comprises abrasive particles secured to a substrate by at least one binder material. The at least one binder material comprises a cured reaction product of components comprising: a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b). Methods of making and using the abrasive articles are also disclosed.

5 Claims, 1 Drawing Sheet

(56) References Cited

U.S. PATENT DOCUMENTS

| | | | |
|---|---|---|---|
| 3,041,156 | A | 6/1962 | Rowse |
| 4,314,827 | A | 2/1982 | Leitheiser |
| 4,623,364 | A | 11/1986 | Cottringer |
| 4,652,275 | A | 3/1987 | Bloecher |
| 4,734,104 | A | 3/1988 | Broberg |
| 4,737,163 | A | 4/1988 | Larkey |
| 4,744,802 | A | 5/1988 | Schwabel |
| 4,751,138 | A | 6/1988 | Tumey |
| 4,770,671 | A | 9/1988 | Monroe |
| 4,799,939 | A | 1/1989 | Bloecher |
| 4,881,951 | A | 11/1989 | Wood |
| 4,997,461 | A | 3/1991 | Markhoff-Matheny |
| 5,009,675 | A | 4/1991 | Kunz |
| 5,011,508 | A | 4/1991 | Wald |
| 5,042,991 | A | 8/1991 | Kunz |
| 5,085,671 | A | 2/1992 | Martin |
| 5,108,463 | A | 4/1992 | Buchanan |
| 5,137,542 | A | 8/1992 | Buchanan |
| 5,152,917 | A | 10/1992 | Pieper |
| 5,201,916 | A | 4/1993 | Berg |
| 5,203,884 | A | 4/1993 | Buchanan |
| 5,213,591 | A | 5/1993 | Celikkaya |
| 5,328,716 | A | 7/1994 | Buchanan |
| 5,352,254 | A | 10/1994 | Celikkaya |
| 5,366,523 | A | 11/1994 | Rowenhorst |
| 5,378,251 | A | 1/1995 | Culler |
| 5,417,726 | A | 5/1995 | Stout |
| 5,435,816 | A | 7/1995 | Spurgeon |
| 5,436,063 | A | 7/1995 | Follett |
| 5,496,386 | A | 3/1996 | Broberg |
| 5,505,747 | A | 4/1996 | Chesley |
| 5,520,711 | A | 5/1996 | Helmin |
| 5,556,437 | A | 9/1996 | Lee |
| 5,560,753 | A | 10/1996 | Schnabel |
| 5,565,011 | A | 10/1996 | Follett |
| 5,573,619 | A | 11/1996 | Benedict |
| 5,609,706 | A | 3/1997 | Benedict |
| 5,672,097 | A | 9/1997 | Hoopman |
| 5,681,217 | A | 10/1997 | Hoopman |
| 5,766,277 | A | 6/1998 | DeVoe |
| 5,851,247 | A | 12/1998 | Stoetzel |
| 5,942,015 | A | 8/1999 | Culler |
| 5,946,991 | A | 9/1999 | Hoopman |
| 5,954,844 | A | 9/1999 | Law |
| 5,961,674 | A | 10/1999 | Gagliardi |
| 5,975,987 | A | 11/1999 | Hoopman |
| 5,975,988 | A | 11/1999 | Christianson |
| 5,984,988 | A | 11/1999 | Berg |
| 5,998,540 | A | 12/1999 | Lipkin |
| 6,077,601 | A | 6/2000 | DeVoe |
| 6,129,540 | A | 10/2000 | Hoopman |
| 6,139,594 | A | 10/2000 | Kincaid |
| 6,228,133 | B1 | 5/2001 | Thurber |
| 6,277,160 | B1 | 8/2001 | Stubbs |
| 6,521,005 | B1 | 2/2003 | Vincent |
| 6,843,815 | B1 | 1/2005 | Thurber |
| 7,169,199 | B2 | 1/2007 | Barber, Jr. |
| 7,344,575 | B2 | 3/2008 | Thurber |
| 8,142,531 | B2 | 3/2012 | Adefris |
| 8,142,532 | B2 | 3/2012 | Erickson |
| 8,142,891 | B2 | 3/2012 | Culler |
| 8,940,063 | B2 | 1/2015 | Yang |
| 9,457,453 | B2 | 10/2016 | Seth |
| 9,849,563 | B2 | 12/2017 | Thurber |
| 10,022,841 | B2 | 7/2018 | Hsu |
| 2005/0182187 | A1 | 8/2005 | Koonce |
| 2009/0165394 | A1 | 7/2009 | Culler |
| 2009/0169816 | A1 | 7/2009 | Erickson |
| 2010/0130104 | A1* | 5/2010 | Everts ..... C08K 5/005 451/28 |
| 2012/0227333 | A1 | 9/2012 | Adefris |
| 2013/0040537 | A1 | 2/2013 | Schwabel |
| 2013/0125477 | A1 | 5/2013 | Adefris |
| 2013/0130600 | A1 | 5/2013 | Carrozzella |
| 2016/0068729 | A1 | 3/2016 | Erickson |
| 2017/0129075 | A1* | 5/2017 | Thurber ..... B24D 3/28 |
| 2017/0225298 | A1* | 8/2017 | Goers ..... B24D 3/14 |
| 2021/0078138 | A1 | 3/2021 | Martinez |

FOREIGN PATENT DOCUMENTS

| | | | |
|---|---|---|---|
| EP | 0776733 | 6/1997 | |
| WO | WO 2011163461 | * 12/2011 | ..... B32B 27/00 |
| WO | WO 2016-064726 | 4/2016 | |

OTHER PUBLICATIONS

International Search Report for PCT International Application No. PCT/IB2020/050810, mailed on Apr. 20, 2020, 4 pages.

* cited by examiner

ABRASIVE ARTICLES AND METHODS OF MAKING AND USING THE SAME

CROSS REFERENCE TO RELATED APPLICATIONS

This application is a national stage filing under 35 U.S.C. 371 of PCT/IB2020/050810, filed Jan. 31, 2020, which claims the benefit of Provisional Application No. 62/803,879, filed Feb. 11, 2019.

TECHNICAL FIELD

The present disclosure broadly relates to abrasive articles and methods of making and using them.

BACKGROUND

Abrasive articles containing from the abrasive particles secured to a backing by a binder are useful for abrading, finishing, or grinding a wide variety of materials and surfaces in the manufacturing of goods. Two common types of abrasive articles are coated abrasive articles and nonwoven abrasive articles.

Coated abrasive articles generally have an abrasive layer typically secured to a relatively dense backing such as, for example, woven or knitted fabric, vulcanized fiber, polymer film, or paper. The abrasive layer comprises abrasive particles and one or more binders that secure the abrasive particles to the backing.

One common type of coated abrasive article has an abrasive layer comprised of a make layer, a size layer, and abrasive particles. In making such a coated abrasive article, a make layer precursor comprising a curable make resin is applied to a major surface of the backing. Abrasive particles are then at least partially embedded into the curable make resin (e.g., via electrostatic coating), and the curable make resin is at least partially cured (that is, crosslinked) to adhere the abrasive particles to the backing. A size layer precursor comprising a curable size resin is then applied over the at least partially cured curable make resin and abrasive particles, followed by curing of the curable size resin precursor, and optionally further curing of the curable make resin.

Some coated abrasive articles additionally have a supersize layer covering the abrasive layer. The supersize layer typically includes grinding aids and/or anti-loading materials.

Some coated abrasive articles have one or more backing treatments such as a backsize layer (i.e., a layer on the major surface of the backing opposite the major surface having the abrasive layer), a presize layer, a tie layer (i.e., a layer between the abrasive layer and the major surface to which the abrasive layer is secured), a saturant, a subsize treatment, or a combination thereof. A subsize is similar to a saturant except that it is applied to a previously treated backing.

Two common forms of coated abrasive articles are discs and belts. During abrading operations using belts, the abrading action of the belt on a workpiece (e.g., wood) increases the load on the drive motor used to drive the belt, and hence an increase in electrical current draw by the motor.

In the case of nonwoven abrasive articles, the binder material precursor is commonly coated on a lofty open nonwoven fiber web, the abrasive particles are secured to the fiber web by a binder material. Typically, to make nonwoven abrasive articles, a curable binder material precursor is coated on a lofty open nonwoven fiber web, the abrasive particles are adhered to the binder material precursor (and/or mixed into the curable binder material precursor, and then the curable binder material precursor is cured sufficiently to form the binder, thereby retaining the abrasive particles during use. Such nonwoven abrasive articles are used extensively in the manufacture of abrasive articles for cleaning, abrading, finishing, and polishing applications on any of a variety of surfaces. Exemplary of such nonwoven abrasive articles are those described in U.S. Pat. No. 2,958,593 (Hoover et al.). Exemplary commercial nonwoven abrasive articles include nonwoven abrasive hand pads such as those marketed by 3M Company of Saint Paul, Minnesota under the trade designation SCOTCH-BRITE.

There continues to be a need for improving the cost, performance, and/or life of abrasive articles such as coated abrasives and nonwoven abrasives.

SUMMARY

In one aspect, the present disclosure provides an abrasive article comprising abrasive particles secured to a substrate by at least one binder material, wherein the at least one binder material comprises a cured reaction product of components comprising:

a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b).

In a second aspect, the present disclosure provides a method of abrading a workpiece, the method comprising frictionally contacting an abrasive article according to the present disclosure with a surface of the workpiece and moving at least one of the abrasive article or the workpiece to abrade the surface of the workpiece.

In a third aspect, the present disclosure provides a method of making an abrasive article, the method comprising:

disposing a first curable binder precursor on a substrate, wherein the first curable binder precursor comprises:

a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b);

contacting the first curable binder precursor with abrasive particles; and at least partially curing the first curable binder precursor.

Advantageously, phenolic/polyurethane binder materials according to the present disclosure may impart desirable toughness and brittleness/stiffness properties to abrasive articles in which they are incorporated.

As used herein:

"cured reaction product of components comprising" means that a curable composition comprising all of the components specified is cured to provide a cured reaction product, but not necessarily that every component in the curable composition is involved in the curing reaction;

"substantially free of" means containing less than 0.1 percent by weight of;

"total solids weight" refers to the total weight of material exclusive of volatile components (including water and/or organic solvents); and the term "volatile" means readily vaporizable at a temperature of less than or equal to 40° C. at one atmosphere (102 kPa) of pressure.

Features and advantages of the present disclosure will be further understood upon consideration of the detailed description as well as the appended claims.

Figure 1:
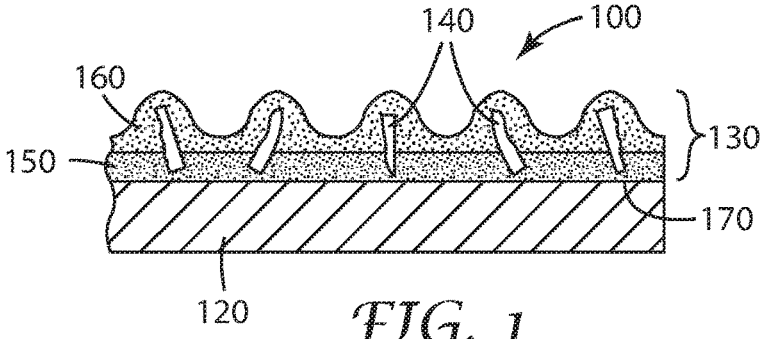
FIG. 1 is a cross-sectional view of exemplary coated abrasive article 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Abrasive articles according to the present disclosure comprise abrasive particles secured to a substrate (e.g., a coated abrasive backing or a lofty open nonwoven fiber web) by at least one binder material.

Referring to FIG. 1, an exemplary coated abrasive article 100 has backing 120 and abrasive layer 130 according to the present disclosure. Abrasive layer 130, in turn, includes abrasive particles 140 secured to major surface 170 of backing 120 by make layer 150 and size layer 160.

Suitable materials for the substrate include polymeric films, metal foils, woven fabrics, knitted fabrics, paper, vulcanized fiber, nonwovens, foams, screens, laminates, combinations thereof, and treated versions thereof. The backing may also be a laminate of two materials (e.g., paper/film, cloth/paper, or film/cloth). The backing may also be a fibrous reinforced thermoplastic such as described, for example, as described, for example, in U.S. Pat. No. 5,417,726 (Stout et al.), or an endless spliceless belt, as described, for example, in U.S. Pat. No. 5,573,619 (Benedict et al.). The backing may be a polymeric substrate having hooking stems projecting therefrom such as that described, for example, in U.S. Pat. No. 5,505,747 (Chesley et al.), or the backing may be a loop fabric such as that described, for example, in U.S. Pat. No. 5,565,011 (Follett et al.). For applications where stiffness of the backing is desired, a flexible backing may also be used by affixing it to a rigid backup pad mounted to the grinding tool.

The choice of backing material may depend on the intended application of the coated abrasive article. The thickness and smoothness of the backing should also be suitable to provide the desired thickness and smoothness of the coated abrasive article, wherein such characteristics of the coated abrasive article may vary depending, for example, on the intended application or use of the coated abrasive article. For disc grinding applications where stiffness and cost are concerns, vulcanized fiber backings are typically preferred.

Optionally, an antistatic material may be applied to the backing. The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.).

In some instances, it may be desirable to incorporate a pressure-sensitive adhesive onto the backside of the coated abrasive article such that the resulting coated abrasive article can be secured to a backup pad. Exemplary pressure-sensitive adhesives include latex crepe, rosin, acrylic polymers, and copolymers including polyacrylate esters (e.g., poly(butyl acrylate)), vinyl ethers (e.g., poly(vinyl n-butyl ether)), alkyd adhesives, rubber adhesives (e.g., natural rubber, synthetic rubber, chlorinated rubber), and mixtures thereof.

Abrasive disc backings are generally circular and preferably rotationally symmetric around their center. Preferably, they have a circular perimeter, but may have additional features along the perimeter such as, for example, in the case of a scalloped perimeter.

Abrasive belt backings are generally flexible and durable. They may be spliced or spliceless.

To promote adhesion of binder resins to the backing, one or more surfaces of the backing may be modified by known methods including corona discharge, ultraviolet light exposure, electron beam exposure, flame discharge, and/or scuffing.

Likewise, the backing may include one or more treatments selected from a backsize layer, a presize layer, a tie layer, a saturant, a subsize treatment, or a combination thereof.

Details concerning coated abrasive articles comprising abrasive particles and make, size, and optional supersize layers are well known and are described, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

The abrasive layer may comprise a single binder layer having abrasive particles retained therein, or more typically, a multilayer construction having make and size layers. Coated abrasives according to the present disclosure may optionally include additional layers such as, for example, a supersize layer that is superimposed on the abrasive layer, or a backing antistatic treatment layer may also be included, if desired.

Exemplary suitable binders can be prepared from thermally curable resins, radiation-curable resins, and combinations thereof.

According to the present disclosure, at least one binder material (e.g., the make layer or a slurry layer—including a structure abrasive layer)) secures the abrasive particles to the backing and comprises a cured reaction product of components comprising:

a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b).

Suitable phenolic resins are generally formed by condensation of phenol or an alkylated phenol (e.g., cresol) and formaldehyde, and are usually categorized as resole or novolac phenolic resins. Novolac phenolic resins are acid-catalyzed and have a molar ratio of formaldehyde to phenol of less than 1:1. Resole (also resol) phenolic resins can be catalyzed by alkaline catalysts, and the molar ratio of formaldehyde to phenol is greater than or equal to one, typically between 1.0 and 3.0, thus presenting pendant methylol groups. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

Phenolic resins are well-known and readily available from commercial sources. Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Florida under the trade designation AEROFENE (e.g., AEROFENE 295); and those marketed by Kangnam Chemical Company Ltd. of Seoul, South Korea under the trade designation PHENOLITE (e.g., PHENOLITE TD-2207).

Typically, it is preferred that the phenolic resin comprise a resole resin; however, this is not a requirement.

Suitable polyurethane dispersions may include aliphatic and/or aromatic polyurethane dispersions. More specifically, the polyurethane may comprise a polycarbonate polyurethane, a polyester polyurethane, or polyether polyurethane. The polyurethane may comprise a homopolymer or a copolymer.

Examples of commercially available polyurethane dispersions include aqueous aliphatic polyurethane emulsions available as NEOREZ R-960, NEOREZ R-966, NEOREZ R-967, NEOREZ R-9036, and NEOREZ R-9699 from DSM Neo Resins, Inc., Wilmington, Massachusetts; aqueous anionic polyurethane dispersions available as ESSENTIAL CC4520, ESSENTIAL CC4560, ESSENTIAL R4100, and ESSENTIAL R4188 from Essential Industries, Inc., Merton, Wisconsin; polyester polyurethane dispersions available as SANCURE 843, SANCURE 898, and SANCURE 12929 from Lubrizol, Inc. of Cleveland, Ohio; an aqueous aliphatic self-crosslinking polyurethane dispersion available as TURBOSET 2025 from Lubrizol, Inc.; and an aqueous anionic, co-solvent free, aliphatic self-crosslinking polyurethane dispersion, available as BAYHYDROL PR240 from Bayer Material Science, LLC of Pittsburgh, Pennsylvania Additional suitable commercially available aqueous polyurethane dispersions include:

1) Alberdingk U 6150, a solvent-free, aliphatic polycarbonate polyurethane dispersion available from Alberdingk Boley GmbH, Krefeld, Germany, having a viscosity ranging from 50-500 mPa·s (according to ISO 1652, Brookfield RVT Spindle 1/rpm 20/factor 5), an elongation at break of about 200%, and a Koenig hardness after curing of about 65-70 s;
2) Alberdingk U 6800, an aqueous, solvent-free, colloidal, low viscosity dispersion of an aliphatic polycarbonate polyurethane without free isocyanate groups available from Alberdingk Boley GmbH, Krefeld, Germany, having a viscosity ranging from 20-200 mPa·s (according to ISO 2555, Brookfield RVT Spindle 1/rpm 50/factor 2), an elongation at break of about 500%, and a Koenig hardness after curing of about 45 seconds;
3) Alberdingk U 6100, an aqueous, colloidal, anionic, low viscosity dispersion of an aliphatic polyester-polyurethane without free isocyanate groups available from Alberdingk Boley GmbH, Krefeld, Germany, having a viscosity of 20-200 mPa·s (according to ISO 1652, Brookfield RVT Spindle 1/rpm 50 factor 2), an elongation at break of about 300%, and a Koenig hardness after curing of about 50 s;
4) Alberdingk U9800—a solvent-free aliphatic polyester polyurethane dispersion available from Alberdingk Boley GmbH, Krefeld, Germany having a viscosity of 20-200 mPa·s (according to ISO 1652, Brookfield RVT Spindle 1/rpm 20/factor 5), and elongation at break of about 20-50%, and a Koenig hardness after curing of about 100-130 s; and
5) Adiprene BL16—a liquid urethane elastomer with blocked isocyanate curing sites available from Chemtura, Middlebury, Connecticut Optional additives including rheological modifiers, anti-foaming agents, water-based latexes and crosslinkers may be added to the aqueous polyurethane dispersion. Suitable crosslinkers include, for example, polyfunctional aziridine, methoxymethylolated melamine, urea resin, carbodiimide, polyisocyanate and blocked isocyanate. Additional water may also be added to dilute the formulation of the aqueous polyurethane dispersion, the phenolic resin, or combination thereof.

It will be understood that the first binder may be formed using, for example, an aqueous polyurethane dispersion and a water-based latex.

In some embodiments, the aqueous polyurethane dispersion contains less than about 20%, 10%, 5% or 2% organic solvent. In a specific embodiment, the aqueous polyurethane dispersion is substantially free of organic solvent. In some embodiments, it has been found that the aqueous polyurethane dispersion comprises at least about 7%, 15%, or 20% solids, and no greater than about 50% or 60% solids. The aqueous polyurethane dispersion may comprise no greater than about 80%, 85%, or 93% water. In some embodiments, it has been found that the aqueous polyurethane dispersion forms a film having a Koenig hardness of at least about 30 and no greater than about 200 seconds when measured according to ASTM 4366-16. Further, in some embodiments, it has been found that the aqueous polyurethane dispersion may have a surface tension that is at least about 50% of the surface tension of water and no greater than about 300% of the surface tension of water. And in some embodiments, the aqueous polyurethane dispersion may have a viscosity of at least about 10 mPa s to no greater than about 600 mPa s, or at least about 70%, 80% or 90% of the viscosity of water and no greater than about 600%, 500% or 400% of the viscosity of water.

In addition, in some embodiments, the aqueous polyurethane dispersion may comprise at least about 100, 1000, or even at least about 10000 parts per million (ppm) of dimethylolpropionic acid. Optional additives including rheological modifiers, anti-foaming agents, and crosslinkers may be added to the aqueous polyurethane dispersion, for example. Suitable crosslinkers include, for example, polyfunctional aziridine, methoxymethylolated melamine, urea resin, carbodiimide, polyisocyanate and blocked isocyanate. Additional water may be added to reduce viscosity of the aqueous polyurethane dispersion. Likewise, addition of up to 10 percent by weight of organic solvent (e.g., propyl methyl ether or isopropanol) to the aqueous polyurethane dispersion may be used to reduce viscosity and/or improve the miscibility of ingredients.

Preferably, the dispersed polyurethane includes at least one polycarbonate segment, although this is not a requirement.

The phenolic resin and aqueous polyurethane dispersion components are mixed in a solids weight ratio of 56 to 91 percent by weight phenolic resin to 44 to 9 percent by weight of polyurethane. In some embodiments, the phenolic resin and aqueous polyurethane dispersion components are mixed in a solids weight ratio of 62 to 91 percent by weight phenolic resin to 38 to 9 percent by weight of polyurethane. In some embodiments, the phenolic resin and aqueous polyurethane dispersion components are mixed in a solids weight ratio of 69 to 91 percent by weight phenolic resin to 31 to 9 percent by weight of polyurethane. In some embodiments, the phenolic resin and aqueous polyurethane dispersion components are mixed in a solids weight ratio of 56 to 83 percent by weight phenolic resin to 44 to 17 percent by weight of polyurethane. In some embodiments, the phenolic resin and aqueous polyurethane dispersion components are mixed in a solids weight ratio of 56 to 76 percent by weight phenolic resin to 44 to 24 percent by weight of polyurethane. In some embodiments, the phenolic resin and aqueous polyurethane dispersion components are mixed in a solids weight ratio of 56 to 69 percent by weight phenolic resin to 44 to 31 percent by weight of polyurethane.

The make layer precursor may be applied by any known coating method for applying a make layer to a backing such as, for example, including roll coating, extrusion die coating, curtain coating, knife coating, gravure coating, and spray coating.

The basis weight of the make layer utilized may depend, for example, on the intended use(s), type(s) of abrasive particles, and nature of the coated abrasive disc being prepared, but typically will be in the range of from 1, 2, 5, 10, or 15 grams per square meter (gsm) to 20, 25, 100, 200, 300, 400, or even 600 gsm. The make layer may be applied by any known coating method for applying a make layer (also referred to in the art as a make coat) to a backing, including, for example, roll coating, extrusion die coating, curtain coating, knife coating, gravure coating, and spray coating.

Once the make layer precursor is coated on the backing, the abrasive particles are applied to and embedded in the make layer precursor.

Crushed abrasive or non-abrasive particles may be included in the abrasive layer between the abrasive elements and/or abrasive platelets, preferably in sufficient quantity to form a closed coat (i.e., substantially the maximum possible number of particles of nominal specified grade(s) that can be retained in the abrasive layer).

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, MN; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles; and combinations thereof. Of these, molded sol-gel derived alpha alumina triangular abrasive platelets are preferred in many embodiments. Abrasive material that cannot be processed by a sol-gel route may be molded with a temporary or permanent binder to form shaped precursor particles which are then sintered to form triangular abrasive platelets, for example, as described in U.S. Pat. Appln. Publ. No. 2016/0068729 A1 (Erickson et al.).

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. U.S. Pat. No. 4,652,275 (Bloecher et al.) or U.S. Pat. No. 4,799,939 (Bloecher et al.). In some embodiments, the triangular abrasive platelets may be surface-treated with a coupling agent (e.g., an organosilane coupling agent) or other physical treatment (e.g., iron oxide or titanium oxide) to enhance adhesion of the abrasive particles to the binder (e.g., make and/or size layer). The abrasive particles may be treated before combining them with the corresponding binder precursor, or they may be surface treated in situ by including a coupling agent to the binder.

Preferably, sol-gel-derived abrasive particles comprise shaped (e.g., triangular) abrasive platelets. Triangular abrasive platelets composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Pat. Appln. Publ. Nos. 2009/0165394 A1 (Culler et al.) and 2009/0169816 A1 (Erickson et al.).

Alpha-alumina-based triangular abrasive platelets can be made according to well-known multistep processes. Briefly, the method comprises the steps of making either a seeded or non-seeded sol-gel alpha alumina precursor dispersion that can be converted into alpha alumina; filling one or more mold cavities having the desired outer shape of the triangular abrasive platelet with the sol-gel, drying the sol-gel to form precursor triangular abrasive platelets; removing the precursor triangular abrasive platelets from the mold cavities; calcining the precursor triangular abrasive platelets to form calcined, precursor triangular abrasive platelets, and then sintering the calcined, precursor triangular abrasive platelets to form triangular abrasive platelets. The process will now be described in greater detail.

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

The abrasive particles may include a single kind of triangular abrasive particles or a blend of two or more sizes, shapes, and/or compositions of abrasive particles. In some preferred embodiments, triangular abrasive platelets are precisely-shaped in that individual triangular abrasive platelets will have a shape that is essentially the shape of the portion of the cavity of a mold or production tool in which the particle precursor was dried, prior to optional calcining and sintering.

Triangular abrasive platelets used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant triangular abrasive platelets have a respective nominal average shape that corresponds to the shape of cavities (e.g., truncated pyramid) in the tool surface; however, variations (e.g., random variations) from the nominal average shape may occur during manufacture, and triangular abrasive platelets exhibiting such variations are included within the definition of triangular abrasive platelets as used herein.

In some embodiments, the base and the top of the triangular abrasive platelets are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to triangular abrasive platelets, the term "length" refers to the maximum dimension of a triangular abrasive platelet. "Width" refers to the maximum dimension of the triangular abrasive platelet that is perpendicular to the length. The terms "thickness" or "height" refer to the dimension of the triangular abrasive platelet that is perpendicular to the length and width.

Examples of sol-gel-derived triangular alpha alumina (i.e., ceramic) abrasive platelets can be found in U.S. Pat. No. 5,201,916 (Berg); U.S. Pat. No. 5,366,523 (Rowenhorst (Re 35,570)); and U.S. Pat. No. 5,984,988 (Berg). Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

The triangular abrasive platelets are typically selected to have a length in a range of from 1 micron to 15000 microns, more typically 10 microns to about 10000 microns, and still more typically from 150 to 2600 microns, although other lengths may also be used.

Triangular abrasive platelets are typically selected to have a width in a range of from 0.1 micron to 3500 microns, more typically 100 microns to 3000 microns, and more typically 100 microns to 2600 microns, although other lengths may also be used.

Triangular abrasive platelets are typically selected to have a thickness in a range of from 0.1 micron to 1600 microns, more typically from 1 micron to 1200 microns, although other thicknesses may be used.

In some embodiments, triangular abrasive platelets may have an aspect ratio (length to thickness) of at least 2, 3, 4, 5, 6, or more.

Surface coatings on the triangular abrasive platelets may be used to improve the adhesion between the triangular abrasive platelets and a binder in coated abrasive discs, or can be used to aid in electrostatic deposition of the triangular abrasive platelets. In one embodiment, surface coatings as described in U.S. Pat. No. 5,352,254 (Celikkaya) in an amount of 0.1 to 2 percent surface coating to triangular abrasive platelet weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the triangular abrasive platelet from capping. Capping is the term to describe the phenomenon where metal particles from the workpiece being abraded become welded to the tops of the triangular abrasive platelets. Surface coatings to perform the above functions are known to those of skill in the art.

The abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include 1158, 11512, 11516, JIS24, JIS36, JIS46, JIS54, 11560, 11580, JIS100, JIS150, JIS180, JIS220, JIS240, JIS280, JIS320, JIS360, 115400, 115600, 115800, JIS1000, JIS1500, JIS2500, 1154000, 1156000, 1158000, and JIS10000. According to one embodiment of the present disclosure, the average diameter of the abrasive particles may be within a range of from 260 to 1400 microns in accordance with FEPA grades F60 to F24.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the abrasive particles pass through a test sieve meeting ASTM E-11 specifications for the number 18 sieve and are retained on a test sieve meeting ASTM E-11 specifications for the number 20 sieve. In one embodiment, the abrasive particles have a particle size such that most of the particles pass through an 18 mesh test sieve and can be retained on a 20, 25, 30, 35, 40, 45, or 50 mesh test sieve. In various embodiments, the abrasive particles can have a nominal screened grade of: −18+20, −20/+25, −25+30, −30+35, −35+40, −40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size can be used such as −90+100.

After deposition of the abrasive particles, the make layer precursor is at least partially cured; for example, using heat and/or electromagnetic radiation.

A size layer precursor is the disposed over at least a portion of the at least partially cured make layer and abrasive particles and at least partially cured to further secure the abrasive particles to the backing. The size layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant α,β-unsaturated groups, acrylated urethane, acrylated epoxy, acrylated isocyanurate), epoxy resin (including bis-maleimide and fluorene-modified epoxy resins), isocyanurate resin, and mixtures thereof. If phenolic resin is used to form the make layer, it is likewise preferably used to form the size layer. The size layer precursor may be applied by any known coating method for applying a size layer to a backing, including roll coating, extrusion die coating, curtain coating, knife coating, gravure coating, spray coating, and the like. If desired, a presize layer precursor or make layer precursor according to the present disclosure may be also used as the size layer precursor.

The basis weight of the size layer will also necessarily vary depending on the intended use(s), type(s) of abrasive particles, and nature of the coated abrasive disc being prepared, but generally will be in the range of from 1 or 5 grams per square meter (gsm) to 300 gsm, 400 gsm, or even 500 gsm, or more. The size layer precursor may be applied by any known coating method for applying a size layer precursor (also referred to in the art as a size coat) to a backing including, for example, roll coating, extrusion die coating, curtain coating, and spray coating.

In some embodiments, the size layer comprises components a) and b) of the first binder precursor, although different ratios of the components may be used. In some embodiments, the make layer and the size layer are the same.

Figure 2:
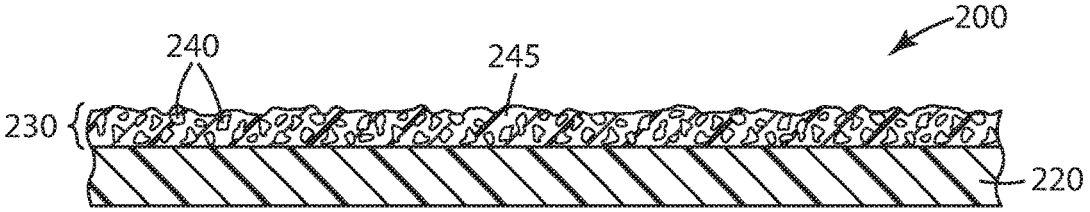
FIG. 2 is a cross-sectional view of exemplary coated abrasive article 200 according to the present disclosure.

In another exemplary embodiment of a coated abrasive article according to the present disclosure, the abrasive layer may comprise a cured slurry of a binder precursor and abrasive particles. Referring to FIG. 2, exemplary coated abrasive article 200 has backing 220 and abrasive layer 230. Abrasive layer 230, in turn, includes abrasive particles 240 and binder 245 according to the present disclosure.

In this embodiment, the abrasive particles are dispersed throughout a binder precursor which may be any composition described as for the make layer precursor above and coated on the backing. Likewise, the abrasive particles may be as described hereinbefore. In preferred embodiments, such coated abrasive articles may have a desired topography imparted to the abrasive surface. For example, the abrasive layer may comprise shaped abrasive composites, which in some embodiments are precisely-shaped, secured to the backing. Structured abrasive articles fall in this category.

Further details concerning structured coated abrasive articles may be found, for example, in U.S. Pat. No. 5,152,917 (Pieper et al.); U.S. Pat. No. 5,378,251 (Culler et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,851,247 (Stoetzel et al.); U.S. Pat. No. 5,942,015 (Culler et al.); U.S. Pat. No. 6,139,594 (Kincaid et al.); U.S. Pat. No. 6,277,160 (Stubbs et al.); and U.S. Pat. No. 7,344,575 (Thurber et al.).

Once applied, the size layer precursor, and typically the partially cured make layer precursor, are sufficiently cured to provide a usable coated abrasive disc. In general, this curing step involves thermal energy, although other forms of energy such as, for example, radiation curing may also be used. Useful forms of thermal energy include, for example, heat and infrared radiation. Exemplary sources of thermal energy include ovens (e.g., festoon ovens), heated rolls, hot air blowers, infrared lamps, and combinations thereof.

In addition to other components, binder precursors, if present, in the make layer precursor and/or presize layer precursor of coated abrasive discs according to the present disclosure may optionally contain catalysts (e.g., thermally activated catalysts or photocatalysts), free-radical initiators (e.g., thermal initiators or photoinitiators), curing agents to facilitate cure. Such catalysts (e.g., thermally activated catalysts or photocatalysts), free-radical initiators (e.g., thermal initiators or photoinitiators), and/or curing agents may be of any type known for use in coated abrasive discs including, for example, those described herein.

In addition to other components, the make and size layer precursors may further contain optional additives, for example, to modify performance and/or appearance. Exemplary additives include grinding aids, fillers, plasticizers, wetting agents, surfactants, pigments, coupling agents, fibers, lubricants, thixotropic materials, antistatic agents, suspending agents, and/or dyes.

Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium. Examples of other grinding aids include sulfur, organic sulfur compounds, graphite, and metallic sulfides. A combination of different grinding aids can be used.

Exemplary antistatic agents include electrically conductive material such as vanadium pentoxide (e.g., dispersed in a sulfonated polyester), humectants, carbon black and/or graphite in a binder.

Examples of useful fillers for this disclosure include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite.

Optionally a supersize layer may be applied to at least a portion of the size layer. If present, the supersize typically includes grinding aids and/or anti-loading materials. The optional supersize layer may serve to prevent or reduce the accumulation of swarf (the material abraded from a workpiece) between abrasive particles, which can dramatically reduce the cutting ability of the coated abrasive disc. Useful supersize layers typically include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals. Useful supersize materials are further described, for example, in U.S. Pat. No. 5,556,437 (Lee et al.). Typically, the amount of grinding aid incorporated into coated abrasive articles is about 50 to about 400 gsm, more typically about 80 to about 300 gsm. The supersize may contain a binder such as for example, those used to prepare the size or make layer, but it need not have any binder.

Further details concerning coated abrasives comprising an abrasive layer secured to a backing, wherein the abrasive layer comprises abrasive particles and make, size, and optional supersize layers are well known, and may be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

Figure 3A:
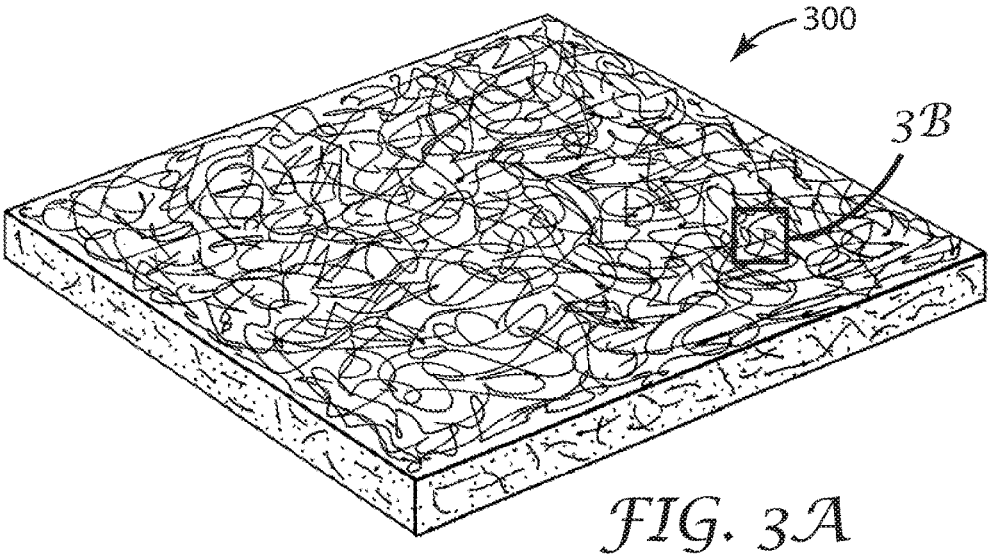
FIG. 3A is a perspective view of an exemplary nonwoven abrasive article 300 according to the present disclosure.
Figure 3B:
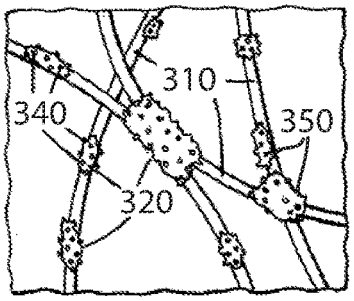
FIG. 3B is an enlarged view of region 3B of the nonwoven abrasive article shown in FIG. 3A.

Nonwoven abrasive articles typically include a porous (e.g., a lofty open porous) polymer filament structure having abrasive particles bonded thereto by a binder. An exemplary embodiment of a nonwoven abrasive article according to the present disclosure is shown in FIGS. 3A and 3B, wherein lofty open nonwoven web 300 is formed of entangled fibers 310 and is impregnated with binder 320 according to the present disclosure. Abrasive particles 340 are dispersed throughout fibrous web 300 on exposed surfaces of fibers 310. Binder resin 320 uniformly coats portions of fibers 310 and forms globules 350 which may encircle individual fibers or bundles of fibers, adhere to the surface of the fibers and/or collect at the intersection of contacting fibers, providing abrasive sites throughout the nonwoven abrasive article.

The lofty open fiber web is a lofty nonwoven fibrous material having a substantially continuous network of voids extending therethrough. By use of the term "lofty open fiber web", what is intended is a layer of nonwoven web material composed of a plurality of randomly oriented fibers, typically entangled, having a substantially continuous network of interconnecting voids extending therethrough.

Nonwoven fiber webs are typically selected to be suitably compatible with adhering binders and abrasive particles while also being processable in combination with other components of the article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), polyamides (e.g., nylon 6, nylon 6/6, and nylon 10), polyolefins (e.g., polyethylene, polypropylene, and polybutylene), acrylic polymers (e.g., polyacrylonitrile and copolymers containing acrylic monomers), rayon, cellulose acetate, polyvinylidene chloride-vinyl chloride copolymers, and vinyl chloride-acrylonitrile copolymers. Examples of suitable natural fibers include cotton, wool, jute, and hemp. The fibers may be of virgin material or of recycled or waste material, for example, reclaimed from garment cuttings, carpet manufacturing, fiber manufacturing, or textile processing. The fibers may be homogenous or a composite such as a bicomponent fiber (e.g., a co-spun sheath-core fiber). The fibers may be tensilized and crimped. They may be chopped fibers (i.e., staple fibers) or continuous filaments such as those formed by an extrusion process. Combinations of fibers may also be used.

The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (1.7 dtex, 1.7 grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide a nonwoven abrasive article that upon use will result in a specifically preferred surface finish.

Nonwoven fiber webs may be made, for example, by conventional air laid, carded, stitch bonded, spun bonded, wet laid, and/or melt blown procedures. Air laid fiber webs may be prepared using equipment such as, for example, that available as a RANDO WEBBER from Rando Machine Company of Macedon, New York.

Frequently, as known in the abrasive art, it is useful to apply a pre-bond resin to the nonwoven fiber web prior to coating with the curable composition. The pre-bond resin serves, for example, to help maintain the nonwoven fiber web integrity during handling, and may also facilitate bonding of the urethane binder to the nonwoven fiber web. Examples of pre-bond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted to bond the fibers together at their points of crossing contact. In those cases, wherein the nonwoven fiber web includes thermally bondable fibers, thermal bonding of the nonwoven fiber web may also be helpful to maintain web integrity during processing.

The lofty open fiber web typically has a thickness of at least 3 mm, more typically at least 6 millimeters, and more typically at least 10 millimeters, although other thicknesses may also be used. Common thicknesses for the lofty open fiber web are, for example, 6.35 mm (¼ inch) and 12.7 mm (½ inch). Addition of a pre-bond binder onto the fibrous mat does not significantly alter the thickness of the lofty open fiber web.

The basis weight of the lofty open fiber web (fibers only, with no pre-bond binder layer) is typically from about 50 grams per square meter to about 1 kilogram per square meter, and more typically from about 70 to about 600 grams per square meter, although other basis weights may also be used. Typically, a pre-bond binder is applied to the lofty open fiber web to lock the fibers. The basis weight of the lofty open fiber web, with pre-bond binder, is typically from about 60 grams per square meter to about 2 kilograms per square meter, and more typically from about 80 grams to about 1.5 kilogram per square meter, although this is not a requirement.

The lofty open fiber web can be prepared by any suitable web forming operation. For example the lofty open fiber web may be carded, spunbonded, spunlaced, melt blown, air laid, or made by other processes as are known in the art. For example, the lofty open fiber web may be cross-lapped, stitchbonded, and/or needletacked.

In this embodiment, the abrasive particles are dispersed throughout a binder precursor which may be any composition described as for the make layer precursor above and coated on the backing. Likewise, the abrasive particles may be as described hereinbefore.

The nonwoven abrasive member may be manufactured through well-known conventional processes that include steps such as, for example, applying a curable binder precursor material (hereinafter referred to as "binder precursor") and abrasive particles to a lofty open nonwoven fiber web followed by curing the binder precursor. The abrasive particles may be applied in combination with the binder precursor as a slurry, or more desirably the abrasive particles may be applied (e.g., by dropping, blowing, or spraying) to the binder precursor after it is coated onto the lofty open nonwoven fiber web. The binder precursor typically comprises a thermosetting resin and an effective amount of a curative for the thermosetting resin. The binder precursor may also include various other additives such as, for example, fillers, plasticizers, surfactants, lubricants, colorants (e.g., pigments), bactericides, fungicides, grinding aids, and antistatic agents.

One exemplary method of making nonwoven abrasive members suitable for use in practice of the present disclosure includes sequentially: applying a pre-bond coating to a nonwoven fiber web (e.g., by roll-coating or spray coating), curing the pre-bond coating, impregnating the pre-bonded nonwoven fiber web with a binder precursor (e.g., by roll-coating or spray coating), and curing the curable composition.

Typically, the binder precursor (including any solvent and abrasive particles that may be present) is coated onto the nonwoven fiber web in an amount of from 125 grams per square meter (gsm) to 2080 gsm, more typically 500-2000 gsm, and even more typically 1250-1760 gsm, although values outside these ranges may also be used.

The slurry layer precursor is typically applied to the fiber web in liquid form (e.g., by conventional methods), and subsequently hardened (e.g., at least partially cured) to form a layer coated on at least a portion of the fiber web. Slurry layer precursors utilized in practice according to the present disclosure may typically be cured by exposure to, for example, thermal energy (e.g., by direct heating, induction heating, and/or by exposure to microwave and/or infrared electromagnetic radiation) and/or actinic radiation (e.g., ultraviolet light, visible light, particulate radiation). Exemplary sources of thermal energy include ovens, heated rolls, and/or infrared lamps.

In one exemplary method, a slurry layer precursor comprising abrasive particles and a slurry layer precursor material is applied to the fiber web and then at least partially cured. Optionally, a second binder precursor material (i.e., a size layer precursor), which may be the same as or different from the slurry layer precursor may be applied to the slurry layer, typically after at least partially curing the slurry layer precursor.

In another exemplary method, a make layer precursor (e.g., as described hereinabove) is applied to the lofty open nonwoven fiber web, abrasive particles are deposited on the make layer, and then the make layer precursor is hardened (e.g., by evaporation, cooling, and/or at least partially curing). Subsequently, a size layer precursor (as described hereinabove), which may be the same as or different from the make layer precursor, is typically, but optionally, applied over the make layer and abrasive particles, and then at least partially cured.

Suitable methods for applying slurry layer precursors, make layer precursors, size layer precursors, etc. are well known in the art of nonwoven abrasive articles, and include coating methods such as curtain coating, roll coating, spray coating, and the like. Typically, spray coating is an effective and economical method for applying slurry layer and make layer precursors. The optional size layer may be elastomeric or non-elastomeric and may contain various additives such as, for example, one or more of a lubricant and/or a grinding aid. The optional size layer may comprise an elastomer (e.g., a polyurethane elastomer). Exemplary useful elastomers include those known for use as a size layer for nonwoven abrasive articles. For example, elastomers may be derived from isocyanate-terminated urethane pre-polymers such as, for example, those commercially available under the trade designations VIBRATHANE or ADIPRENE from Crompton & Knowles Corporation, Middlebury, Connecticut; and MONDUR or DESMODUR from Bayer Corporation, Pittsburgh, Pennsylvania.

Optionally, a slurry layer, make layer, and/or size layer may further include one or more catalysts and/or curing agents to initiate and/or accelerate the curing process (e.g., thermal catalyst, hardener, crosslinker, photocatalyst, thermal initiator, and/or photoinitiator) as well as in addition, or alternatively, other known additives such as, for example, fillers, thickeners, tougheners, grinding aids, pigments, fibers, tackifiers, lubricants, wetting agents, surfactants, antifoaming agents, dyes, coupling agents, plasticizers, and/or suspending agents. Exemplary lubricants include metal stearate salts such as lithium stearate and zinc stearate, or materials such as molybdenum disulfide, and mixtures thereof.

As used herein, the term "grinding aid" refers to a non-abrasive (e.g., having a Mohs hardness of less than 7) particulate material that has a significant effect on the chemical and physical processes of abrading. In general, the addition of a grinding aid increases the useful life of a nonwoven abrasive. Exemplary grinding aids include inorganic and organic materials, include waxes, organic halides (e.g., chlorinated waxes, polyvinyl chloride), halide salts (e.g., sodium chloride, potassium cryolite, cryolite, ammonium cryolite, potassium tetrafluoroborate, sodium tetrafluoroborate, silicon fluorides, potassium chloride, magnesium chloride), metals (e.g., tin, lead, bismuth, cobalt, antimony, cadmium, iron, and titanium and their alloys), sulfur, organic sulfur compounds, metallic sulfides, graphite, and mixtures thereof.

Coated abrasive articles according to the present invention are useful for abrading a workpiece. One such method includes frictionally contacting at least a portion of the abrasive layer of a coated abrasive article with at least a portion of a surface of the workpiece, and moving at least one of the coated abrasive article or the workpiece relative to the other to abrade at least a portion of the surface.

Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades.

Coated abrasive articles according to the present invention may be used by hand and/or used in combination with a machine. At least one or both of the coated abrasive article and the workpiece is generally moved relative to the other when abrading.

Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, and/or the like.

SELECT EMBODIMENTS OF THE PRESENT DISCLOSURE

In a first embodiment, the present disclosure provides an abrasive article comprising abrasive particles secured to a substrate by at least one binder material, wherein the at least one binder material comprises a cured reaction product of components comprising:

a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b).

In a second embodiment, the present disclosure provides an abrasive article according to the first embodiment, wherein the substrate comprises a lofty open nonwoven fiber web.

In a third embodiment, the present disclosure provides an abrasive article according to the first embodiment, wherein the substrate comprises a knit or woven cloth fabric backing.

In a fourth embodiment, the present disclosure provides an abrasive article according to any one of the first to third embodiments, wherein the at least one binder material comprises a make layer and a size layer, and wherein the make layer comprises the cured reaction product.

In a fifth embodiment, the present disclosure provides an abrasive article according to any one of the first to fourth embodiments, wherein the at least one polyurethane comprises a polyurethane dispersion having at least one polycarbonate segment.

In a sixth embodiment, the present disclosure provides a method of abrading a workpiece, the method comprising frictionally contacting an abrasive article according to any one of the first to fifth embodiments with a surface of the workpiece and moving at least one of the abrasive article or the workpiece to abrade the surface of the workpiece.

In a seventh embodiment, the present disclosure provides a method of making an abrasive article, the method comprising:

disposing a first curable binder precursor on a substrate, wherein the first curable binder precursor comprises:

a) at least one phenolic resin; and b) an aqueous dispersion of at least one polyurethane, wherein, based on the total solids weight of components a) and b), the components comprise 56 to 91 percent by weight of component a) and 44 to 9 percent by weight of component b);

contacting the first curable binder precursor with abrasive particles; and at least partially curing the first curable binder precursor.

In an eighth embodiment, the present disclosure provides a method according to the seventh embodiment, wherein contacting the first curable binder precursor with the abrasive particles occurs prior to disposing the first curable binder precursor on the substrate.

In a ninth embodiment, the present disclosure provides a method according to the seventh or eighth embodiment, wherein the substrate comprises a lofty open nonwoven fiber web.

In a tenth embodiment, the present disclosure provides a method according to the seventh or eighth embodiment, wherein the substrate comprises a knit or woven cloth fabric backing.

In an eleventh embodiment, the present disclosure provides a method according to any one of the seventh to tenth embodiments, further comprising disposing a second curable binder precursor onto at least a portion of the at least partially cured first curable binder precursor and the abrasive particles, and at least partially curing the second curable binder precursor.

In a twelfth embodiment, the present disclosure provides a method according to any one of the seventh to eleventh embodiments, wherein the at least one polyurethane comprises a polyurethane dispersion having at least one polycarbonate segment.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Materials used in the Examples are listed in Table 1, below.

TABLE 1

| ABBREVIATION | MATERIAL |
|---|---|
| Fb1 | 15 denier (17 dTex) × 1.5 inches (3.8 cm) staple length High Tenacity Nylon 66 fiber produced by EMS CHEMIE, Austria |
| Fb2 | 20 denier (22 dTex) × 1.5 inches (3.8 sm) staple length Standard Tenacity Nylon 66 fiber produced by EMS CHEMIE |
| Wa | Tap water |
| PMA | propylene glycol monomethyl ether acetate, obtained from Ashland Chemical Co., Columbus, Ohio |
| PME | propylene glycol monomethyl ether, obtained from Dow Chemical Corporation, Midland, Michigan |
| LAPONITE | Laponite RDS layered silicate from BYK-Chemie Gmbh, Wesel, Germany |
| L1 | a 1.52 wt. % dispersion of LAPONITE synthetic clay (Southern Clay Products, Inc. Gonzales, Texas) in a mixture of 84.4 wt. % of water, 14.07 wt. % PME and 0.01 wt. % GEO |
| SR | 2-hydroxymethylene urea (75% solids in water) obtained as SR511A from Sartomer Co., Exton, Pennsylvania |
| D1 | 2,5,8,11-tetramethyl-6-dodecyn-5,8-diol ethoxylate surfactant obtained as Dynol 604 from Air Products and Chemicals, Allentown, Pennsylvania |

TABLE 1-continued

| ABBREVIATION | MATERIAL |
|---|---|
| B7 | resole phenolic resin (70% solids in water) available as BB077 from SI Group, Mumbai, India |
| S2 | Secondary alcohol ethoxylate nonionic surfactant, available as Tergitol 15-S-5 from Dow Chemical Co., Midland, Michigan |
| GEO | anti-foam agent, obtained as GEO FM LTX from GEO Specialty Chemicals, Ambler, Pennsylvania |
| LiSt | lithium stearate solution consisting of 79.5 wt. % water, 18 wt. % C14-18 lithium stearate, 2 wt. % polystyrene-acrylate emulsion (obtained as JONCRYL 89 from BASF, Florham Park, New Jersey), and 0.5 wt. % sodium lauryl sulfate |
| P1 | red pigment, aqueous dispersion, obtained as RPD-0210 from Sun Chemical Corporation, Cincinnati, Ohio |
| P3 | Black dye solution containing 45 wt. % of PME, 45 wt. % of water and 10 wt. % of ELCACID NIGROSINE WSJ black dye obtained from Greenville Colorants, LLC, East Jersey City, New Jersey |
| P4 | Red dye solution consisting of 89.2 wt. % of PME, 4.1 wt. % of P3, and 6.7 wt. % of DISPERSE RED 17 obtained from American Dyestuff Corp., Clifton, New Jersey. |
| Alox 220 | Fused and fired Aluminium oxide particles of size 220, produced by Triebacher, Austria |
| Alox 14 | a 9:1 (wt.:wt.) mixture of Alox 220 and equilateral triangular shaped alpha-alumina alumina abrasive platelets having an edge length of 157 microns, a thickness 50.5 microns, and a 98 degree draft angle preparable generally according to the procedure described in U.S. Pat. Appln. Publ. No. 2016/0068729 A1 (Erickson et al.) |
| AP320 | Fused and fired Aluminum oxide particles of size 320, produced by Triebacher, Austria |
| AP220 | Fused and fired Aluminum oxide particles of size 320, produced by Triebacher, Austria |
| 14EQ 300 | Ultrafine grade Precision Shaped Grains produced by 3M USA, equilateral triangular shaped alpha-alumina alumina abrasive platelets having an edge length of 157 microns, a thickness 50.5 microns, and a 98 degree draft anglepreparable generally according to the procedure described in U.S. Pat. Appln. Publ. No. 2016/0068729 A1 (Erickson et al.) |
| 16EQ | Precision shaped grains produced by 3M, St. Paul, Minnesota. |
| AP180 | Fused and fired Aluminum oxide particles of size 180, produced by Triebacher, Austria |
| AP280 | DURALUM G52 brown aluminum oxide abrasive particles, grade 280/600, from Washington Mills Electro Minerals Corp., Niagara Falls, New York |
| SiC | silicon carbide, black, grade P1500, obtained from GNP Ceramics LLC, Clarence Center, New York |
| U0 | a solvent-free, aliphatic polycarbonate polyurethane dispersion having a viscosity ranging from 50-500 mPa · s (according to ISO 1652, Brookfield RVT Spindle 1/rpm 20/factor 5), an elongation at break of about 200%, and a Koenig hardness after curing of about 65-70 s; available as Alberdingk U 6150 from Alberdingk Boley GmbH, Krefeld, Germany |
| BL16 | polyurethane prepolymer, obtained as ADIPRENE BL-16 from Chemtura Corporation, Middlebury, Connecticut |
| K450 | LAPDX K-450 aromatic amine hardener diluted to 42.3 weight percent in PMA, from Royce International, East Rutherford, New Jersey. |
| Col1 | carbon black pigment, obtained as C-SERIES BLACK 7 LCD4115 from Sun Chemical Corporation, Cincinnati, Ohio |
| Fil2 | Silicon Dioxide Cabosil M5 from ET HORN CO, La Mirada California. |
| Ant | Synthetic Paraffin MP22 obtained from Micro powders Inc, Tarrytown, New York |

Schiefer Test

Two nonwoven abrasive article test specimens were prepared as 10.2-cm diameter discs that are stacked and then secured to a foam back-up pad by means of a hook-and-loop fastener. The back-up pad/fastener assembly had a Shore Durometer OO hardness of 85. The abrasive disc and back-up pad assembly was installed on a Schiefer Uniform Abrasion Tester (available from Frazier Precision Instrument Company, Inc. Hagerstown, Maryland), and the abrasive disc was used to abrade an annular ring (10.2 cm outside diameter (OD)×5.1 cm inside diameter (ID)) of cellulose acetate butyrate polymer from Seelye-Eiler Plastics Inc., Bloomington, Minnesota. The load was 5 lb (2.27 kg). The test duration was 4000 cycles. The amount of cellulose acetate butyrate polymer removed (cumulative cut) was measured at the end of the test period. Wear, measured as percent weight loss of the working nonwoven abrasive article test specimen, was also recorded.

Comparative Example A

A lightweight, open, low-density air-laid nonwoven web was prepared from Fiber Fb1 or Fb2 using a RANDO-WEBBER machine, commercially available from the Rando Machine Corporation of Macedon, New York. The resulting lofty open fiber web had a nominal basis weight of 37 grains per 24 square inches (155 gsm), and the thickness was 0.35 inches (9 mm). The web was conveyed to a horizontal two-roll coater, where a pre-bond resin consisting of 74.89 wt. % of PMA, 5.53 wt. % of K450, 15.07 wt. % of BL16, 0.01 wt. % of GEO, and 4.5 wt. % of P4 was applied to the fiber web at a wet add-on weight of 7 grains/24 square inches (29.3 gsm).

The coated web was conveyed through an oven maintained at 163-177° C. with a residence time of 3 minutes. The resulting pre-bonded fiber web was conveyed to a spray booth where a resin/abrasive slurry consisting of 9.41 wt. % of L1, 0.55 wt. % of SR, 0.01 wt. % of D1, a pre-blend of 17.12 wt. % of B7 and 10.34 wt. % of U0, 0.1 wt. % of S2, 6.0 wt. % of Wa, and 56.47 wt. % of Alox 220 was sprayed on the top surface of the web. Within the booth, spray nozzles (which are mounted to reciprocate perpendicularly to the direction of web movement) apply the slurry at a wet weight of about 67 grains/24 square inch (280 gsm).

The slurry-coated web was then heated in an oven maintained at 177° C. for 3 minutes. The web was then inverted and the slurry spray coating was applied to the opposite side of the web. The coated web was finally heated in an oven maintained at 177° C. for 3 minutes, to yield a nonwoven abrasive article, which was tested according to the Schiefer Test, Test results are reported in Table 4.

Comparative Example B

COMPARATIVE EXAMPLE B was made as COMPARATIVE EXAMPLE A, except using the following raw materials weight percentages: 9.41 wt. % of L1, 10.34 wt. % of U0, 0.55 wt. % of SR, 0.01 wt. % of D1, 17.12 wt. % of B7, 0.10 wt. % of S2, 50.82 wt. % of Alox 220, 5.65 wt. % of 14EQ 300, 6.00 wt. % of Wa.

Examples 1-6

Examples 1-6 were made exactly the same as COMPARATIVE EXAMPLE A, except using the raw materials weight percentages shown in TABLE 2 (below).

TABLE 2

| RAW MATERIAL | EXAMPLE 1 wt. % | EXAMPLE 2 wt. % | EXAMPLE 3 wt. % | EXAMPLE 4 wt. % | EXAMPLE 5 wt. % | EXAMPLE 6 wt. % |
|---|---|---|---|---|---|---|
| L1 | 19.36 | 19.36 | 19.36 | 19.36 | 19.36 | 19.36 |
| P1 | 0.00 | 0.00 | 0.00 | 0.00 | 0.00 | 0.00 |
| SR | 1.62 | 1.62 | 1.62 | 1.62 | 1.62 | 1.62 |
| D1 | 0.10 | 0.10 | 0.10 | 0.10 | 0.10 | 0.10 |
| B7 | 13.75 | 13.75 | 13.75 | 13.75 | 13.75 | 13.75 |
| S2 | 0.10 | 0.10 | 0.10 | 0.10 | 0.10 | 0.10 |
| AP280 | 65.07 | 0.00 | 0.00 | 0.00 | 0.00 | 0.00 |
| AP320 | 0.00 | 65.07 | 0.00 | 0.00 | 0.00 | 0.00 |
| Alox220 | 0.00 | 0.00 | 65.07 | 0.00 | 58.56 | 32.54 |
| 14EQ 300 | 0.00 | 0.00 | 0.00 | 65.07 | 6.51 | 32.54 |

Table 3, below, reports results from the Schiefer Test hereinabove. None of Examples 1-6 contained a blend of B7 with U0. Wear percentages were higher while Cumulative Cut results were about the same.

TABLE 3

| | CUMULATIVE CUT, grams | CUMULATIVE WEAR, % wt. loss |
|---|---|---|
| COMPARATIVE EXAMPLE A | 0.54 | 0.09 |
| COMPARATIVE EXAMPLE B | 0.58 | 0.11 |
| EXAMPLE 1 | 0.75 | 0.28 |
| EXAMPLE 2 | 0.77 | 0.41 |

TABLE 3-continued

| | CUMULATIVE CUT, grams | CUMULATIVE WEAR, % wt. loss |
|---|---|---|
| EXAMPLE 3 | 0.59 | 0.27 |
| EXAMPLE 4 | 0.06 | 0.28 |
| EXAMPLE 5 | 0.65 | 0.42 |
| EXAMPLE 6 | 0.34 | 0.20 |

Example 7

A curable composition was prepared, under high speed dispersion, using a high shear blade between 600 rpm to 900 rpm, until a homogeneous mix is obtained, by blending B7 with U0, then under shear adding D1, GEO, Col1, Sic, Fil1, Ant and slowly adding Fil2. The proportions of each component are given in Table 4.

TABLE 4

| Ingredients | Wt. % |
|---|---|
| B7 | 55-75 |
| U0 | 1-10 |
| D1 | 0.005-0.02) |
| GEO | 0.0005-0.003 |
| Fil1 | 10-20 |
| Sic | 1-10 |
| Col | 0.1-0.5 |
| Fil2 | 1-5 |
| Ant | 1-10 |

Using a patterned 3 mil polyester stencil (3M PET liner RM 2123773, film) placed over a continuous film (PE85-60 30610536 Hot melt web 48 inches wide (72 gsm) available from Bostik, Inc., Wauwatosa, Wisconsin; hereinafter "Bostik") previously laminated on a loop backing (Net Mesh GR150 H100 available from SitiP, S.p.A., Cene, Italy), the curable composition described in this example is stencil printed by bringing the backing and the stencil in contact, applying the curable composition to the side of the stencil opposite the laminated backing, forcing the resin through the stencil with a blading mechanism, then separating the screen/stencil and backing leaving a coating on the backing on top of the continuous film, the amount of curable composition is 100 gsm, having a film thickness of 100 microns. Then while the curable composition is still wet, 50 gsm blend of 70% AP180 and 30% 16EQ are electrostatically coated (Spellman SL 150). The entire construction is then thermally pre-cured in a batch oven at 80° C. for 30 minutes and final cured in a batch oven at 103° C. for four hours. During this final stage the curable composition is cured and the Bostik melts, wicking down the threads and screen of the backing, reopening a number of the original holes of the backing. In this instance, a minimum 90% of original holes were reopened.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making an abrasive article, the method comprising:

disposing a first water-based curable binder precursor on a substrate, wherein the first water-based curable binder precursor comprises a blend of:

a) at least one phenolic resin as a solution with water; and b) an aqueous dispersion of at least one polyurethane, wherein, based on the total solids weight of components a) and b), the components comprise 56 to 91 percent by weight of component a) and 44 to 9 percent by weight of component b);

contacting the first water-based curable binder precursor with abrasive particles, wherein contacting the first water-based curable binder precursor with the abrasive particles occurs prior to disposing the first curable binder precursor on the substrate, the abrasive particles being dispersed throughout the curable binder precursor to form a slurry layer precursor; and at least partially curing the first curable binder precursor.

2. The method of claim 1, wherein the substrate comprises a lofty open nonwoven fiber web.

3. The method of claim 1, wherein the substrate comprises a knit or woven cloth fabric backing.

4. The method of claim 1, further comprising disposing a second curable binder precursor onto at least a portion of the at least partially cured first curable binder precursor and the abrasive particles, and at least partially curing the second curable binder precursor.

5. The method of claim 1, wherein the at least one polyurethane comprises a polyurethane dispersion having at least one polycarbonate segment.

* * * * *